US011517863B2

(12) United States Patent
Al-Gouhi et al.

(10) Patent No.: US 11,517,863 B2
(45) **Date of Patent: *Dec. 6, 2022**

(54) WATER SEPARATION IN FLOWLINES OR TRUNK LINES

(71) Applicant: Saudi Arabian Oil Company, Dhahran (SA)

(72) Inventors: Alwaleed Abdullah Al-Gouhi, Dhahran (SA); Nabil S. Alkhanaifer, Dammam (SA); Abdullah M. Al-Zahrani, Dhahran (SA); Mutaz Al Daas, Dhahran (SA); Rayid S. Al-Anazi, Dammam (SA); Yaseen Abdulhameed Bokhamseen, Eastern Province (SA); Abdullah S. Alsaddah, Dhahran (SA); Jana Mohammed Aljindan, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 181 days.

This patent is subject to a terminal disclaimer.

(21) Appl. No.: 16/928,419

(22) Filed: Jul. 14, 2020

(65) Prior Publication Data

US 2020/0338508 A1 Oct. 29, 2020

Related U.S. Application Data

(63) Continuation of application No. 15/833,059, filed on Dec. 6, 2017, now Pat. No. 10,722,854.

(Continued)

(51) Int. Cl.
*B01F 25/82* (2022.01)
*E21B 43/34* (2006.01)

(Continued)

(52) U.S. Cl.
CPC ..... *B01F 25/821* (2022.01); *B01F 25/823* (2022.01); *B01F 33/502* (2022.01);

(Continued)

(58) Field of Classification Search
CPC ..... B01F 25/821; B01F 33/502; B01F 35/93; E21B 43/34

(Continued)

(56) References Cited

U.S. PATENT DOCUMENTS 2,747,002 A * 5/1956 Walker ..... E21B 43/34 585/815
2,872,935 A 2/1959 Kenney (Continued)

FOREIGN PATENT DOCUMENTS

| | | |
|---|---|---|
| CA | 1212312 | 10/1986 |
| CA | 1212312 A1 * | 10/1986 |
| GB | 2241443 | 4/1991 |

OTHER PUBLICATIONS

Gulf Cooperation Council Examination Report issued in GCC Application No. GC 2017-34396 dated Aug. 21, 2020, 4 pages.

(Continued)

*Primary Examiner* — Marc C Howell
(74) *Attorney, Agent, or Firm* — Fish & Richardson P.C.

(57) ABSTRACT

A sink is configured to attach to a bottom surface of a flowline that is configured to flow a mixture of at least two immiscible fluids. One of the immiscible fluids is water. The water is more dense than the other of the at least two immiscible fluids. An outlet formed at a bottom portion of the sink. A valve system is connected to the opening. The valve system is configured to open the outlet in response to the water occupying at least a portion of the sink.

26 Claims, 5 Drawing Sheets

Related U.S. Application Data

(60) Provisional application No. 62/593,075, filed on Nov. 30, 2017, provisional application No. 62/430,564, filed on Dec. 6, 2016.

(51) Int. Cl.
*B01F 33/502* (2022.01)
*B01F 35/93* (2022.01)
*B01F 35/90* (2022.01)

(52) U.S. Cl.
CPC ..... *B01F 35/93* (2022.01); *E21B 43/34* (2013.01); *B01F 2035/99* (2022.01)

(58) Field of Classification Search
USPC ..... 366/341
See application file for complete search history.

(56) References Cited

U.S. PATENT DOCUMENTS

| | | | | |
|---|---|---|---|---|
| 3,633,377 | A | 1/1972 | Quick | |
| 3,957,641 | A | 5/1976 | Jakubek et al. | |
| 4,107,052 | A | 8/1978 | Yoshino et al. | |
| 5,149,344 | A * | 9/1992 | Macy | B01D 17/0208 96/182 |
| 6,063,295 | A * | 5/2000 | Williams | C02F 1/74 210/123 |
| 6,368,498 | B1 | 4/2002 | Guilmette | |
| 7,611,635 | B2 | 11/2009 | Chieng et al. | |
| 7,927,161 | B2 | 4/2011 | Schaefer, Jr. | |
| 8,002,121 | B2 | 8/2011 | Berard et al. | |
| 8,414,781 | B2 | 4/2013 | Berard et al. | |
| 2016/0045842 | A1 | 2/2016 | Agar et al. | |
| 2016/0158718 | A1 * | 6/2016 | Straitiff | B60C 25/0596 366/144 |

OTHER PUBLICATIONS

Gulf Cooperation Council Examination Report issued in GCC Application No. GC 2017-39290 dated Jun. 30, 2020, 3 pages.
International Search Report and Written Opinion issued in International Application No. PCT/US2017/064817 dated Jun. 7, 2018, 19 pages.
Gulf Cooperation Council Examination Report issued in GCC Application No. GC 2017-34396 dated Jun. 23, 2019, 3 pages.
Gulf Cooperation Council Examination Report issued in GCC Application No. GC 2017-34396 dated Oct. 31, 2019.
Technip, "Electricity Trace Heated Pipe-in-Pipe," Engineering and Technologies, Jan. 2016, 6 pages.
Shell Global Solutions,"Pure and Simple—Innovative Water Separation Technology Cuts Costs in Oman," Published in 2004, 2 pages.
Innopipe, "Innopipe-Unique inline gas separator and piggable drip system removes 99% of liquids," Innopipe Inline Separators and Drips, Copyright 2017, 3 pages.
Gulf Cooperation Council Examination Report issued in GCC Application No. GC 2017-39290, dated Feb. 25, 2021, 3 pages.

* cited by examiner

WATER SEPARATION IN FLOWLINES OR TRUNK LINES

CROSS-REFERENCE TO RELATED APPLICATIONS

This application is a continuation of and claims the benefit of priority to U.S. patent application Ser. No. 15/833,059, entitled "Water Separation in Flowlines or Trunk Lines", filed on Dec. 6, 2017, which claims priority to U.S. Patent Application No. 62/593,075, entitled "Water Separation in Flowlines or Trunk Lines", filed Nov. 30, 2017, and U.S. Patent Application No. 62/430,564, entitled "Water Separation in Flowlines or Trunk Lines", filed Dec. 6, 2016, the contents of which are incorporated herein by reference in its entirety.

TECHNICAL FIELD

This disclosure relates to flow through flowlines or trunk lines that carry fluids, for example, a mixture of two or more fluids.

BACKGROUND

Flowlines or trunk lines are often implemented to transport fluids between locations. Fluids transported through a flowline or trunk line can be non-homogenous, for example, a mixture of two or more fluids or multi-phase fluids, for example, a mixture of a fluid in the gas. In hydrocarbon implementations, the flowlines or trunk lines can be implemented to transport hydrocarbons between locations. In such implementations, the hydrocarbon can be mixed with water, which can cause corrosion, slugging, back pressure, combinations of them, or other issues in the flow lines or trunk lines.

SUMMARY

This disclosure describes water separation in flowlines or trunk lines.

An example implementation of the subject matter described within this disclosure is a system with the following features. A sink is configured to attach to a bottom surface of a flowline that is configured to flow a mixture of at least two immiscible fluids. One of the immiscible fluids is water. The water is more dense than the other of the at least two immiscible fluids. An outlet formed at a bottom portion of the sink. A valve system is connected to the opening. The valve system is configured to open the outlet in response to the water occupying at least a portion of the sink.

Aspects of the example implementation, which can be combined with the example implementation alone or in combination, include the following. A perforated plate is configured to attach to the bottom surface of the flowline between the flowline and the sink. The perforated plate is configured to flow at least a portion of the mixture of the at least two immiscible fluids from the flowline into the sink.

Aspects of the example implementation, which can be combined with the example implementation alone or in combination, include the following. The valve system includes a valve and a pressure sensor attached to the valve. The pressure sensor is configured to sense hydrostatic fluid pressure.

Aspects of the example implementation, which can be combined with the example implementation alone or in combination, include the following. The pressure sensor is configured to store a pressure value and transmit a valve-open signal to the valve in response to the sensed hydrostatic fluid pressure satisfying the stored pressure value.

Aspects of the example implementation, which can be combined with the example implementation alone or in combination, include the following. The pressure sensor is configured to transmit a valve-close signal to the valve in response to the sensed hydrostatic fluid not satisfying the stored pressure value.

Aspects of the example implementation, which can be combined with the example implementation alone or in combination, include the following. The valve is connected to one or more data networks and is configured to receive a valve-open signal over the one more data networks, open the opening in response to receiving the valve-open signal, receive a valve-close signal over the one or more data networks, and close the opening in response to receiving the valve-close signal.

Aspects of the example implementation, which can be combined with the example implementation alone or in combination, include the following. The valve system includes a valve, a perforated cylinder positioned in the sink, and a sensor system positioned within the cylinder. The sensor system is configured to open the valve based on the water occupying at least a portion of the perforated cylinder.

Aspects of the example implementation, which can be combined with the example implementation alone or in combination, include the following. The sensor system includes an upper sensor attached to an upper surface of the perforated cylinder, a lower sensor attached to a lower surface of the perforated cylinder, and a floating member positioned in the perforated cylinder between the upper sensor and the lower sensor. The floating member is configured to float in water.

Aspects of the example implementation, which can be combined with the example implementation alone or in combination, include the following. The upper sensor is configured to transmit a valve-open signal in response to being contacted by the floating member. The lower sensor is configured to transmit a valve-close signal in response to being contacted by the floating member.

Aspects of the example implementation, which can be combined with the example implementation alone or in combination, include the following. The valve is configured to open the outlet in response to receiving the valve-open signal from the upper sensor. The valve is configured to close the outlet in response to receiving the valve-close signal from the lower sensor.

Aspects of the example implementation, which can be combined with the example implementation alone or in combination, include the following. A weir is positioned in the sink. The weir is configured to accumulate the water in a portion of the sink.

Aspects of the example implementation, which can be combined with the example implementation alone or in combination, include the following. A height of the weir is less than a distance between the bottom surface of the flowline and the bottom portion of the sink.

Aspects of the example implementation, which can be combined with the example implementation alone or in combination, include the following. The sink includes a first portion with an upper end and a lower end. The upper end of the first portion is attached to an upstream end of the bottom portion of the flowline. A second portion includes an upper end and a lower end. The upper end of the second portion is attached to a downstream end of the bottom portion of the flowline. The downstream end is downstream of the upstream end. An intermediate portion includes an upstream end and a downstream end. The upstream end of the intermediate portion is attached to the lower end of the first portion. The downstream end of the intermediate portion is attached to the lower end of the second portion.

Aspects of the example implementation, which can be combined with the example implementation alone or in combination, include the following. Each of the first portion and the second portion is substantially curved.

Aspects of the example implementation, which can be combined with the example implementation alone or in combination, include the following. Each of the first portion and the second portion is substantially flat.

Aspects of the example implementation, which can be combined with the example implementation alone or in combination, include the following. Each of the first portion and the second portion angles downward from the bottom surface of the flowline toward the sink.

Aspects of the example implementation, which can be combined with the example implementation alone or in combination, include the following. An up-slope portion is attached to the flowline. The up-slope portion is positioned downstream of the sink. The up-slope portion tapers in an upstream direction.

Aspects of the example implementation, which can be combined with the example implementation alone or in combination, include the following. The sink is a first sink, and the outlet is a first outlet and the valve system is a first valve system. The system also includes a second sink configured to attach to a bottom surface of the flowline downstream of the second sink, a second outlet formed at a bottom portion of the second sink. and a second valve system connected to the second opening. The second valve system is configured to open the second outlet in response to the water occupying at least a portion of the second sink.

Aspects of the example implementation, which can be combined with the example implementation alone or in combination, include the following. A flowline segment has the bottom surface to which the sink is configured to attach. The flowline segment is separate from the flowline through which the mixture of the at least two immiscible fluids is configured to flow.

Aspects of the example implementation, which can be combined with the example implementation alone or in combination, include the following. An outer diameter and cross-section of the flowline segment is substantially identical to an outer diameter and cross-section, respectively, of the flowline.

Aspects of the example implementation, which can be combined with the example implementation alone or in combination, include the following. A flange system is configured to fluidically connect the flowline segment and the flowline.

Aspects of the example implementation, which can be combined with the example implementation alone or in combination, include the following. A heating coil is positioned within the sink. The heating coil is configured to heat a fluid within the sink to prevent hydrate formation.

Aspects of the example implementation, which can be combined with the example implementation alone or in combination, include the following. The heating coil includes an electric heating coil.

Aspects of the example implementation, which can be combined with the example implementation alone or in combination, include the following. a temperature sensor is configured to detect a temperature within the sink. A temperature controller is configured to regulate an energy flow into the heating coil.

Aspects of the example implementation, which can be combined with the example implementation alone or in combination, include the following. The temperature controller includes a current regulator.

The details of one or more implementations of the subject matter described in this specification are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes technologies relating to removing water from flowlines (or trunk lines) that carry oil or other hydrocarbons that do not mix with water. Implementing the water separation systems described here can result in the separation of water from the fluids flowed through the flowlines. The separated water can be removed from the flowlines or diverted to other portions of the flowlines or both. Removing water can minimize or eliminate corrosion, slugging, back pressure, combinations of them or other water-related issues in flowlines.

Figure 1A:
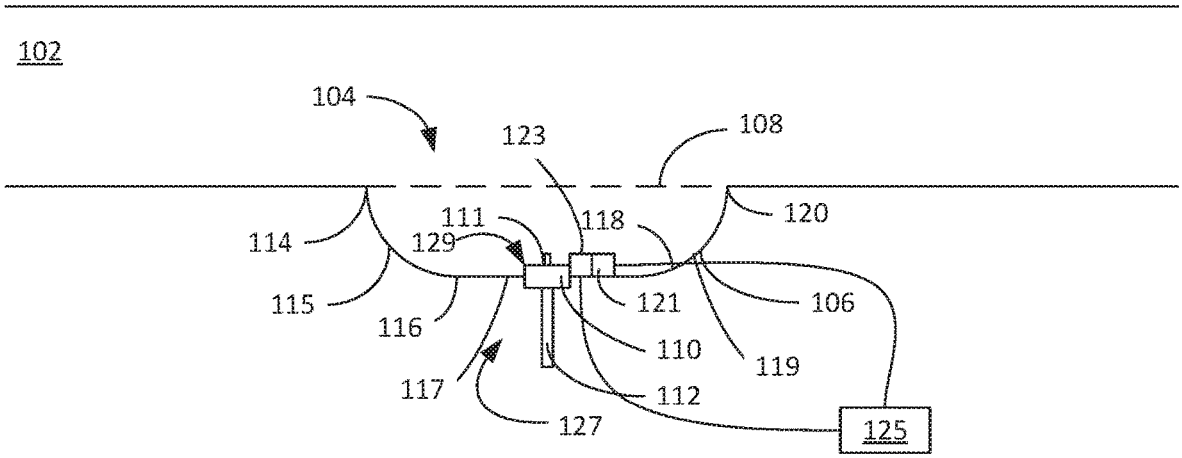
FIGS. 1A and 1B are schematic diagrams of an example of a water separation system in a flowline.
Figure 1B:
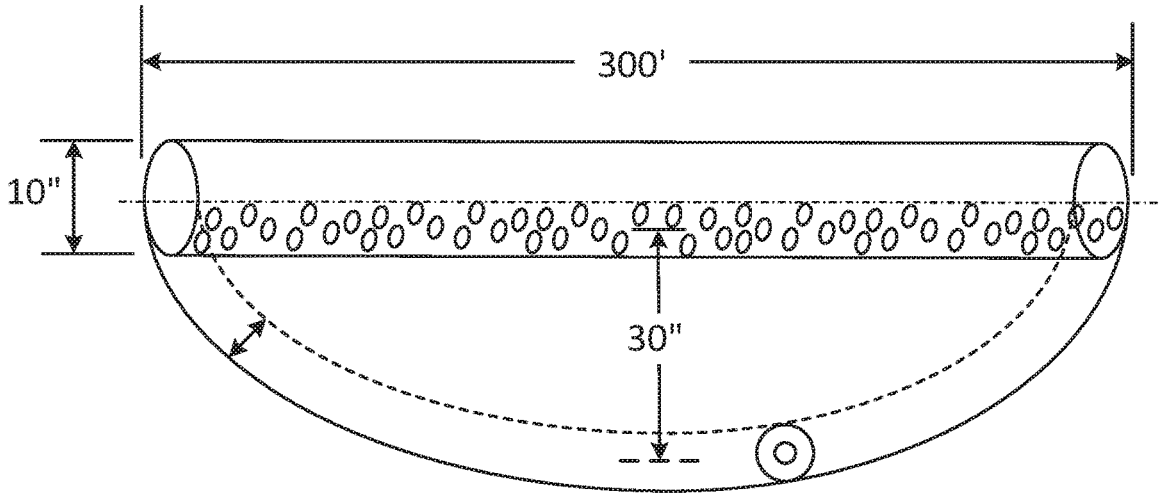

FIG. 1A is a schematic diagram of an example of a water separation system 104 in a flowline 102. The system 104 is implemented in a flowline 102 through which fluids are flowed. FIG. 1B is a perspective view of the schematic diagram of FIG. 1A. In some implementations, for a flowline 102 that is 30 feet long and 10 inches in diameter, the system 104 can have a depth of 30 inches and a thickness of 10 inches. Other, different dimensions for the flowline 102 or the system 104 or both are possible.

The fluids flowed through the flowline 102 can include a mixture of at least two immiscible fluids, one of which is water. The fluids can be single phase (that is, liquids only) or multi-phase (that is, a combination of liquids and gas). In some implementations, the fluids can be hydrocarbons flowed between locations, for example, a production site and a storage site. In the example implementations described here, the water is denser than the other fluids in the mixture allowing the system to separate the water from the other fluids. The system 104 and techniques described here can be implemented in a flowline through which a mixture of any two immiscible fluids are flowed, where one of the fluids is denser than other fluids in the mixture.

The system 104 includes a sink 106 that can be attached to a bottom surface of the flowline 102. To do so, in some implementations, a bottom portion of the flowline 104 can be removed and replaced with the system 104. For example, the system 104 can be welded to the bottom surface of the flowline 102.

An outlet is formed at a bottom portion of the sink 106. A valve system 127 is connected to the opening 129. As described later, the valve system 127 can open the outlet in response to the water in the fluids occupying at least a portion of the sink 106. For example, the fluids flowed through the flowline 102 can include a mixture of hydrocarbons and water, which is denser than the hydrocarbons. Initially, a portion of the mixture flows into and settles in the sink 106. The portion that initially flows into the sink 106 can include hydrocarbons and water in any ratio. Because of the difference in density, the water in the portion settles to the bottom of the sink 106 while the hydrocarbons rise to the top. Over time, as more of the mixture flows into and settles in the sink 106, the quantity of water that settles to the bottom of the sink 106 increases raising the hydrocarbons toward the upper surface of the flowline 102. When the water occupies all or substantially all of the sink 106, the valve system 127 opens the opening 129 allowing the water to be drained from the flowline 102. The water occupies substantially all of the sink 106, for example, 95% or more of the volume of the sink 106 can be occupied by water. After the water has been drained from the flowline 102, the valve system 127 closes the opening 129, and the water collection and separation processes begins once again.

In some implementations, the system 104 includes a heating coil 121 positioned within the sink 106. The heating coil 121 is located near the bottom of the sink near the outlet. The heating coil 121 is configured to heat a fluid within the sink to prevent hydrate formation. The heating coil 121 can include an electric heating coil, a fluid-filled heating coil, or any other type of heating element. When the heating coil 121 includes an electric heating coil, the heating coil can include a Nichrome wire or any other suitable material. While nichrome is the most common resistance wire for heating purposes because it has a high resistivity, other type of heating material, such as aluminum, brass, carbon (amorphous), copper, iron, manganin, molybdenum, nickel, platinum, kanthal, constantan, stainless steel, steel, zinc, or conductive materials can also be used. When the heating coil 121 includes fluid-filled heating coil, the fluid-filled coil includes a flow-line configured to flow heat media through. In such an instance, the heating coil 121 is configured to transfer heat from the heat media to a fluid within the sink 106.

In some implementations, a temperature sensor 123 can be included with the heating coil. The temperature sensor 123 is configured to detect a temperature within the sink 106. A temperature controller 125 is configured to regulate an energy flow into the heating coil. The heating coil is configured to deliver enough heat to prevent or eliminate hydrate formation. For example, in the case of a fluid-filled heating coil, the temperature controller 125 can include a temperature control valve. In the case of an electric heating coil, the temperature controller can include a current regulator.

In some implementations, the system 104 includes a perforated pipe 108 attached to the bottom surface of the flowline 102 between the flowline 102 and the sink 106. The perforated pipe 108 can flow the portion of the mixture of the hydrocarbons and water into the sink 106. To do so, the perforated pipe 108 can include multiple perforations (not shown) distributed along a surface of the plate. In some implementations, the sizes of the perforations can be selected to be small enough to prevent solid particles from falling into the sink 106, for example, rust particles, black powder, flocculent, sand, and other particles. Such an implementation can prevent the drain pip 112 from clogging. Alternatively, or in addition, the size of the perforations can be large enough to allow the mixture of the hydrocarbons and water to fall into the sink 106. The perforated pipe 108 can protect the fluid in the sink 106 from disturbances by the fluid velocity of the mixture in the flowline 102 above the sink 106. To do so, the perforated pipe 108 can be manufactured using a material that can not only resist corrosion due to the flowing mixture but can also absorb forces from the flowing mixture in the flowline 102. For example, one or more or all components of the system 104 can be manufactured using a metal such as chrome 13. In this manner, the perforated pipe 108 can increase a likelihood that the fluid in the sink 106 remains static to allow separation of the water from the hydrocarbons.

The valve system 127 includes a valve 110 and a pressure sensor 111 connected to the valve 110. The pressure sensor 111 can sense hydrostatic fluid pressure. In the example implementation shown in FIG. 1A, the valve 110 covers the opening 129 in the sink 106 and the pressure sensor 111 is attached to the valve 110. In some implementations, the valve 110 can be located away from, but remain connected to, the opening 129 and the pressure sensor 111. In any implementation, the valve 110 can open or close the opening 129 based on receiving a signal from the pressure sensor 111, the signal representing a pressure sensed by the pressure sensor 111.

In some implementations, the opening 129 and closing of the valve 110 can be controlled based on a pre-determined pressure value stored in the pressure sensor 111. For example, the pressure sensor 111 can store an opening pressure value defined by Equation 1:

$$\text{Opening pressure} = \text{Flowline pressure} + (\text{sink depth} \times \rho_{water}) \qquad \text{Equation 1}$$

The flowline pressure is the pressure of the fluid flowing through the flowline 102 above the sink 106. The sink depth is the distance between the perforated pipe 108 and the opening 129, and represents a hydrostatic pressure head on the pressure sensor 111. The density of water is denoted by "$\rho_{water}$". Initially, the pressure sensed by the pressure sensor 111 is the pressure of a mixture of hydrocarbons and water. As water accumulates in the sink 106 and raises the hydrocarbons towards the upper surface of the flowline 102, the pressure sensed by the pressure sensor 111 is the pressure of water alone. When the pressure sensed by the pressure sensor 111 satisfies (that is, is equal to or greater than) the opening pressure value defined by Equation 1, the sink 106 is filled with water. In response, the pressure sensor 111 can transmit a valve-open signal to the valve 110 causing the valve 110 to open the opening 129 allowing the water to be drained out of the sink 106, for example, through a drain pipe 112.

The pressure sensor 111 can store a closing pressure value defined by Equation 2:

$$\text{Closing pressure} = \text{Flowline pressure} + (\text{sink depth} \times \rho_{hydrocarbons}) \qquad \text{Equation 2}$$

The density of oil is denoted by "$\rho_{hydrocarbons}$" As water drains through the drain pipe 112, the quantity of water in the sink 106 decreases and fluids in the mixture begin to flow from the flowline 102 through the perforated pipe 108 into the sink 106 to occupy the volume of the draining water. The pressure sensed by the pressure sensor 111 is the pressure of the mixture of hydrocarbons and water. Once all the water has drained from the sink 106, the sink 106 is filled with the mixture, a portion of which includes the hydrocarbons. Because the water has not had time to settle to the bottom of the sink 106, substantially all of the portion may include hydrocarbons. In such instances, the pressure sensed by the pressure sensor 111 is the pressure of the hydrocarbons. When the pressure sensed by the pressure sensor 111 satisfies (that is, is equal to or lesser than) the closing pressure value defined by Equation 2, the pressure sensor 111 can transmit a valve-close signal to the valve 110 causing the valve 110 to close the opening 129. The water separation process described earlier begins again.

Equations 1 and 2 define opening pressure and closing pressure values, respectively, as being caused by the hydrostatic head of water alone or the hydrostatic head of hydrocarbons alone. Because the hydrostatic head at any time can include both fluids, the control logic executed by the pressure sensor 111 can incorporate some tolerances. For example, the pressure sensor 111 can transmit the valve-open signal if the sensed pressure is within 95% of the opening pressure defined by Equation 1. Similarly, the pressure sensor 111 can delay transmitting the valve-close signal until the sensed pressure is about 105% of the closing pressure defined by Equation 2.

In some implementations, the pressure sensor 111 and the valve 110 need not be connected directly to each other, but instead can be connected indirectly through one or more data networks (not shown). For example, the pressure sensor 111 can be connected to a computer system (not shown) located remotely from the pressure sensor 111 through one or more data networks (for example, a local area network, a wide area network, a wireless network, a Bluetooth network, the Internet, any combination of them or other data networks). The pressure sensor 111 can periodically transmit sensed pressure values over the one or more data networks to the remotely located computer system. For example, the pressure sensor 111 can transmit the sensed pressure values in real-time. That is, a time between the pressure sensor 111 sensing the pressure value and transmitting the pressure value over the data networks can be so small that the sensing and transmission appear to be simultaneous. For example, the time between the sensing and the transmission can be less than one millisecond or between 1 millisecond and one second. Based on the pressure values received from the pressure sensor 111, the remotely located computer system can periodically (for example, in real-time) transmit valve-open or valve-close signals to the valve 110. The valve 110 can open or close the opening 129 in the sink 106 based on the received valve-open or valve-close signals, respectively.

As shown in FIG. 1A, the sink 106 includes a first portion 115 having an upper end 114 attached to an upstream end of the bottom portion of the flowline 102. The sink 106 also includes a second portion 119 having an upper end 120 attached to a downstream end of the bottom portion of the flowline 102. The downstream end is downstream of the upstream end. The sink 106 additionally includes an intermediate portion 117 having an upstream end 116 and a downstream end 118. The upstream end 116 of the intermediate portion 117 is attached to the lower end of the first portion 115. The downstream end 118 of the intermediate portion 117 is attached to the lower end of the second portion 119. In the example sink 106 shown in FIG. 1A, each of the first portion 115 and the second portion 119 are substantially curved. That is, the inner surface of each of the first portion 115 and the second portion 119 can have a radius of curvature sufficient for fluids in the flowlines 102 to flow into the sink 106. In addition, each of the first portion 115 and the second portion 119 can be free of sharp edges in which the fluids may accumulate. The intermediate portion 117 can be substantially flat, that is substantially free of any curvature. In this manner, the first portion 115, the second portion 119 can facilitate fluid flow toward the valve system 127 and the opening 129. Alternative structural designs of the sink 106 are described later.

Figure 2:
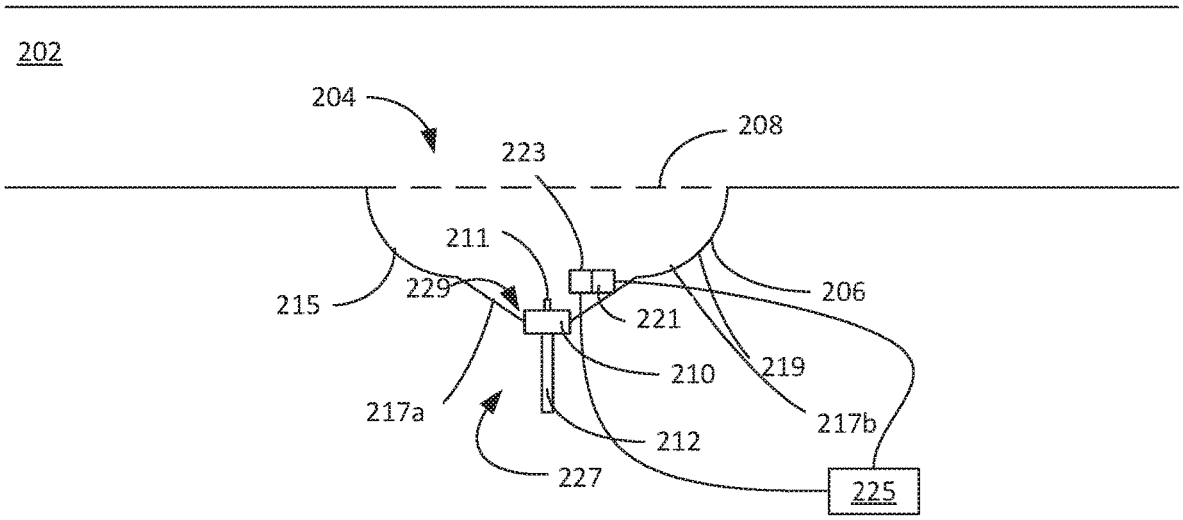
FIG. 2 is a schematic diagram of an example of a water separation system in a flowline.

FIG. 2 is a schematic diagram of an example of a water separation system 204 in a flowline 202. The system 204 includes a sink 206 that can be attached to a bottom surface of the flowline 202. An outlet is formed at a bottom portion of the sink 206. A valve system 227 is connected to the opening 229. In some implementations, the system 204 includes a perforated pipe 208 attached to the bottom surface of the flowline 202 between the flowline 202 and the sink 206. The valve system 227 includes a valve 210, a pressure sensor 211 connected to the valve 210 and a drain pipe 212. The system 204 can include a heating coil 221 positioned within the sink 206. The heating coil 221 can be coupled to a temperature sensor 223 and temperature controller 225. The structural and functional features of components of the system 204 can be substantially similar or identical to the structural and functional features of corresponding components of the system 104. One difference can be the geometric shape of the sink 206 compared to that of the sink 106. For example, the intermediate portion of the sink 206 can include two portions 217*a* and 217*b*, each of which is connected to a lower end of the first portion 215 and the second portion 219, respectively, and that is angled downward toward the valve system 227 and the opening 229. The downward angles can further facilitate fluid flow toward the valve system 227 and the opening 229.

Figure 3:
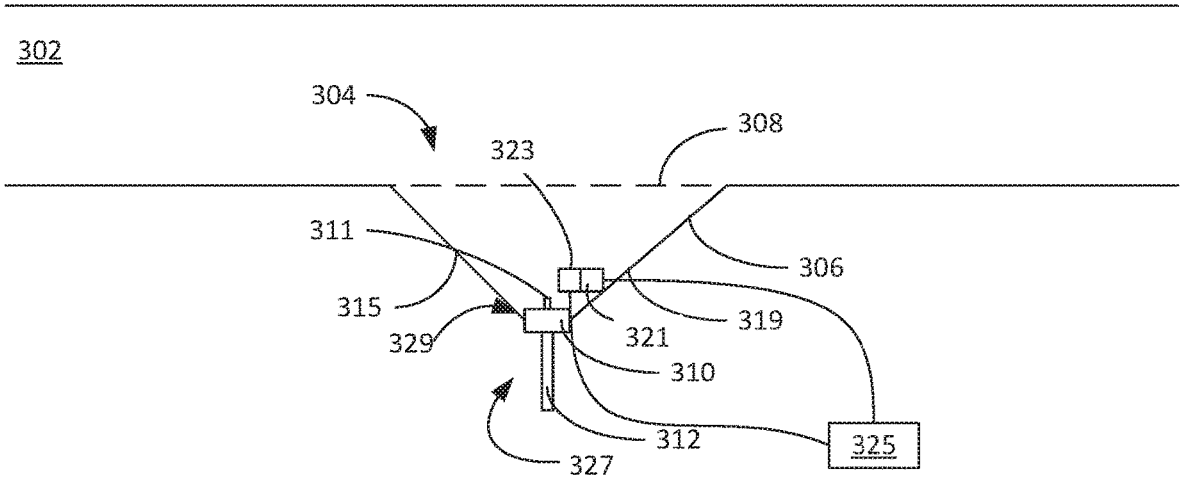
FIG. 3 is a schematic diagram of an example of a water separation system in a flowline.

FIG. 3 is a schematic diagram of an example of a water separation system 304 in a flowline 302. The system 304 includes a sink 306 that can be attached to a bottom surface of the flowline 302. An outlet is formed at a bottom portion of the sink 306. A valve system 327 is connected to the opening 329. In some implementations, the system 304 includes a perforated pipe 308 attached to the bottom surface of the flowline 302 between the flowline 302 and the sink 306. The valve system 327 includes a valve 310, a pressure sensor 311 connected to the valve 310 and a drain pipe 312. The system 304 can include a heating coil 321 positioned within the sink 306. The heating coil 321 can be coupled to a temperature sensor 323 and temperature controller 325. The structural and functional features of components of the system 304 can be substantially similar or identical to the structural and functional features of corresponding components of the system 104. One difference can be the geometric shape of the sink 306 compared to that of the sink 106. For example, the sink 306 need not include an intermediate portion. Instead, each of the first portion 315 and the second portion 319 can be substantially flat and angled from the bottom surface of the flowline 302 toward the valve system 327 and the opening 329. The downward angles can further facilitate fluid flow toward the valve system 327 and the opening 329.

Figure 4:
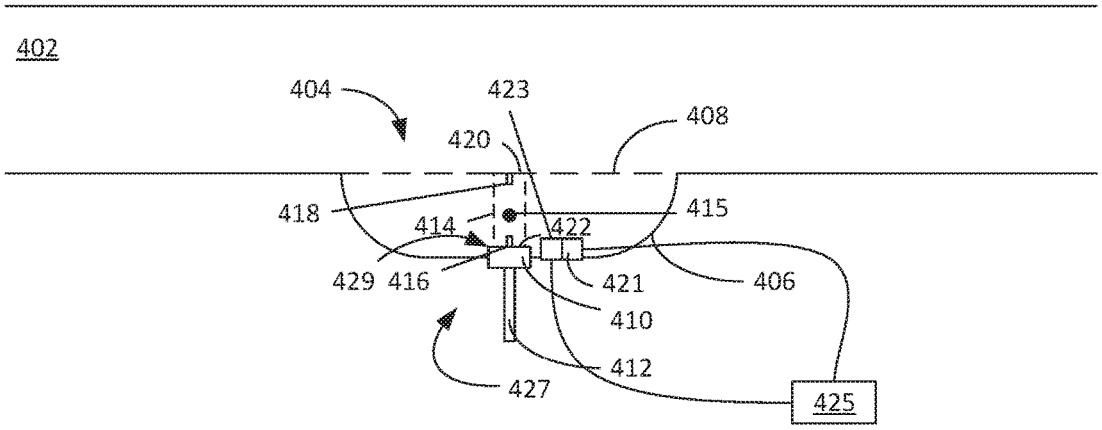
FIG. 4 is a schematic diagram of an example of a water separation system in a flowline.

FIG. 4 is a schematic diagram of an example of a water separation system 404 in a flowline. The system 404 includes a sink 406 that can be attached to a bottom surface of the flowline 402. An outlet is formed at a bottom portion of the sink 406. A valve system 427 is connected to the opening 429. In some implementations, the system 404 includes a perforated pipe 408 attached to the bottom surface of the flowline 402 between the flowline 402 and the sink 406. The valve system 427 includes a valve 410, a sensor system connected to the valve 310 and a drain pipe 412. The system 404 can include a heating coil 421 positioned within the sink 406. The heating coil 421 can be coupled to a temperature sensor 423 and temperature controller 425. The structural and functional features of components of the system 404 can be substantially similar or identical to the structural and functional features of corresponding components of the system 104.

The system 404 includes a perforated cylinder 414 positioned in the sink 406. The cylinder 414 can be open or closed on either or both ends. The sensor system is positioned within the cylinder 414. As described later, the sensor system can open the valve 410 based on the water occupying at least a portion of the cylinder 414. For example, the cylinder 414 spans a distance between the perforated pipe 408 and the bottom of the sink 406. The sensor system includes an upper sensor 418 and a lower sensor 416 attached to an upper surface 420 and a lower surface 422 of the cylinder 414, respectively. The sensor system includes a floating member 415 positioned in the cylinder 414 between the upper sensor 418 and the lower sensor 416. The floating member 415 can be manufactured from a material that causes the floating member 415 to float at a contacting junction between the hydrocarbons and water. That is, as a quantity of water increases and that of hydrocarbons decreases in the sink 406 or vice versa, the contacting junction between the hydrocarbons and water rises or drops. The floating member 415 can remain at the contacting junction between the hydrocarbons and water despite the variations in the quantities of the hydrocarbons and the water. The floating member 415 can be a sphere or any geometric shape.

Each of the upper sensor 418 and the lower sensor 416 is connected to the valve 410, for example, using wires or wirelessly or both. Each sensor is a contact sensor configured to transmit a signal (for example, a valve-open signal or a valve-close signal) in response to being contacted by the floating member 415. For example, a force on either the upper sensor 418 or the lower sensor 416 by the rising floating member 415 or the falling floating member 415, respectively, can be greater than a force on either sensor by either the water or the hydrocarbons. Each of the upper sensor 418 and the lower sensor 416 can be configured to differentiate between a contact by the floating member 415 and a contact by a fluid based on a difference in the force on each sensor by the contacting feature.

Initially (that is, before water has been separated from the hydrocarbons in the sink 406), the floating member 415 is at the bottom of the cylinder 414 and in contact with the lower sensor 416. In this configuration, the lower sensor 416 transmits a valve-close signal to the valve 410, which, in response, retains the opening 429 in a closed state. As water accumulates in the sink 406, the floating member 415 rises towards the upper sensor 418. The lower sensor 416 continues to transmit the valve-close signal to retain the opening 429 in the closed state allowing water to accumulate in the sink 406. When sufficient water accumulates causing the floating member 415 to contact the upper sensor 418, the upper sensor 418 transmits a valve-open signal to the valve 410. Responsively, the valve 410 opens the opening 429 allowing the accumulated water to drain through the drain pipe 412. As the water drains, the floating member 415 falls towards the lower sensor 416. The upper sensor 418 continues to transmit the valve-open signal to retain the opening 429 in an open state allowing water to drain through the drain pipe 412. When sufficient water has drained causing the floating member 415 to contact the lower sensor 416, the lower sensor 416 once again transmits the valve-close signal to the valve 410, and the accumulation process begins again.

Figure 5:
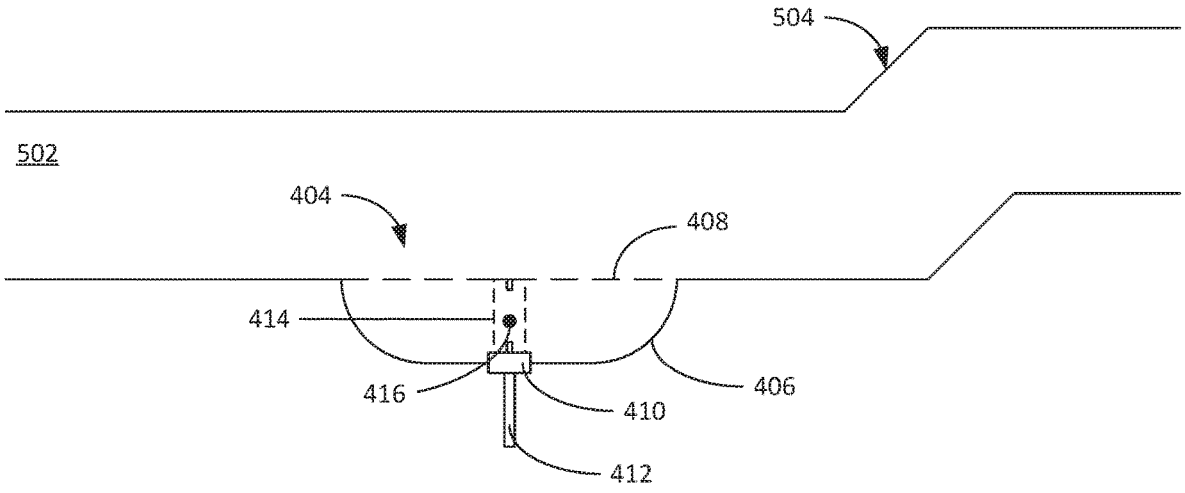
FIG. 5 is a schematic diagram of an example of a water separation system in a flowline.

FIG. 5 is a schematic diagram of an example of a water separation system 404 in a flowline 502. The flowline 502 can alternatively be connected to the water separation system shown in any of the other schematic diagrams. In some implementations, the flowline 502 can include an up-slope portion 504 attached to the flowline 502. The up-slope portion 504 can be downstream of the water separation system 404. The up-slope portion 504 can include a tapering section that tapers in the upstream direction towards the sink 406. The up-slope portion 504 can temporarily slow fluid flow through the flowline 502 to allow water to flow upstream into the sink 406. In the example schematic of FIG. 5, the up-slope portion 502 is shown as having substantially flat surfaces. In some implementations, the up-slope portion 502 can have angled surfaces or a combination of flat and angled surfaces.

Figure 6:
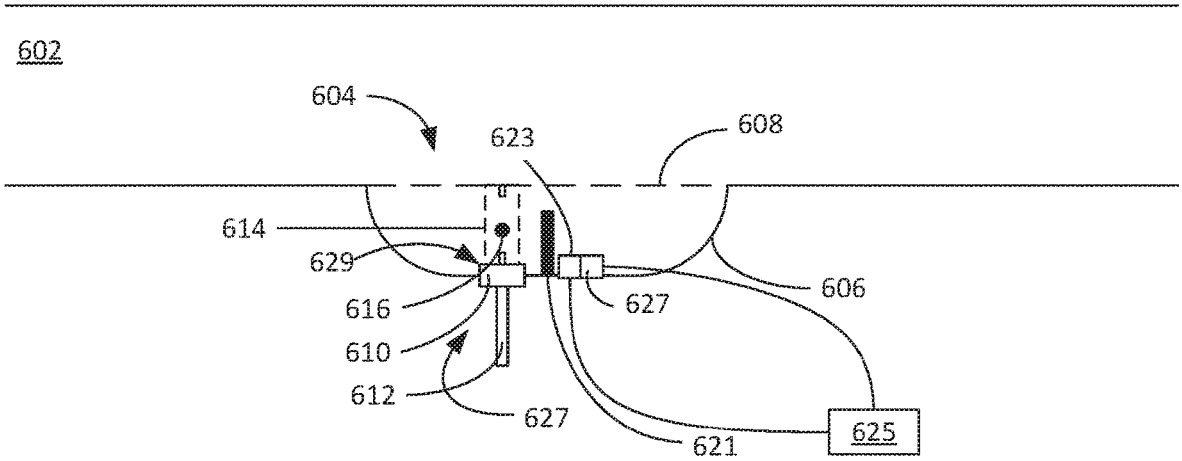
FIG. 6 is a schematic diagram of an example of a water separation system in a flowline.

FIG. 6 is a schematic diagram of an example of a water separation system 604 in a flowline 602. The system 604 includes a sink 606 that can be attached to a bottom surface of the flowline 602. An outlet is formed at a bottom portion of the sink 606. A valve system 627 is connected to the opening 629. In some implementations, the system 604 includes a perforated pipe 608 attached to the bottom surface of the flowline 602 between the flowline 602 and the sink 606. The valve system 627 includes a valve 610, a sensor system connected to the valve 610 and a drain pipe 612. The system 604 can include a heating coil 627 positioned within the sink 606. The heating coil 627 can be coupled to a temperature sensor 623 and temperature controller 625. The heating coil 627 and the temperature sensor 623 can be positioned on either side of a weir 621. The structural and functional features of components of the system 604 can be substantially similar or identical to the structural and functional features of corresponding components of the system 104. In addition, the system 604 includes a perforated cylinder 614 positioned in the sink 606. The sensor system and a floating ball 616 are positioned within the cylinder 614. The floating ball 616 is configured to float in water, but not oil. The ball 616 triggers the valve 610 to open and closed based on its vertical position within the perforated cylinder 614. For example, the ball 616 causes the valve 610 to open when the ball 616 is near the top of the perforated cylinder 614, and the ball 616 closes the valve 610 when the ball 616 is near the bottom of the perforated cylinder 614. The structural and functional features of the perforated cylinder 614 and the sensor system shown in FIG. 6 can be substantially similar or identical to the structural and functional features of corresponding sensor system 414 and the sensor system shown in FIG. 4.

In some implementations, a weir 621 can be positioned in the sink 606. The weir 621 can accumulate the water in a portion of the sink 606. For example, the weir 621 can include a substantially vertical plate having a bottom surface attached to the bottom portion of the sink. That is, the weir 621 can be perpendicular to the bottom portion of the sink 606 or can deviate from perpendicularity by about 10°. The height of the weir 621 can span from the bottom portion of the sink 606 to less than the perforated pipe 608. In operation, the weir 621 can split the sink 606 into two sections—an upstream section and a downstream section. The weir 621 can increase water accumulation on the upstream section compared to the downstream section. As water accumulates in the upstream section, the hydrocarbons rise to the top of the upstream section and overflow into the downstream section. In this manner, loss of hydrocarbons can be minimized.

In some implementations, a valve system 627 can be implemented in the downstream section of the split sink 606. The valve system 627 can retain an opening 629 in the downstream section in a closed state when the overflowing fluid includes hydrocarbons, and can cause the opening 629 to transition to an open state when the overflowing fluid includes water.

Figure 7:
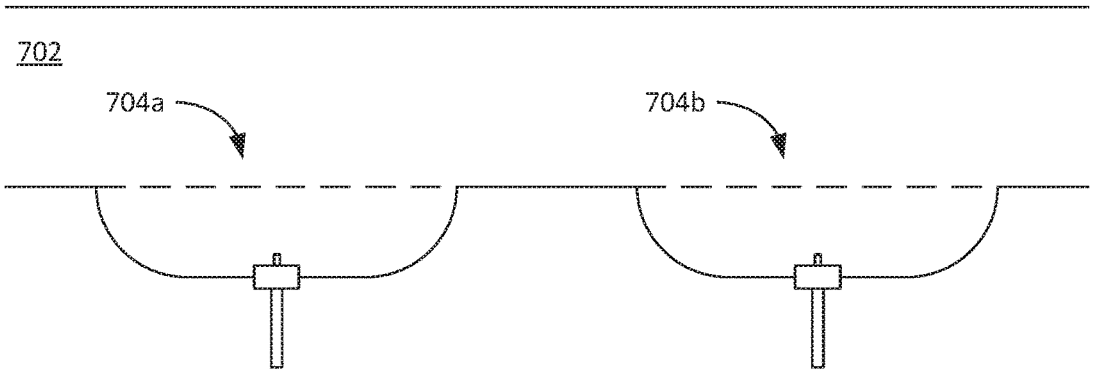
FIG. 7 is a schematic diagram of an example of a water separation system in a flowline.

FIG. 7 is a schematic diagram of an example of a water separation system in a flowline 702. The water separation system includes two sub-systems—a first sub-system 704*a* and a second sub-system 704*b*. Each sub-system includes a sink that can be attached to a bottom surface of the flowline 702. An outlet is formed at a bottom portion of each sink. A valve system is connected to each opening. In some implementations, each sub-system includes a perforated plate attached to the bottom surface of the flowline between the flowline and the sink. Each valve system includes a valve, a pressure sensor connected to the valve and a drain pipe. The structural and functional features of components of each sub-system can be substantially similar or identical to the structural and functional features of corresponding components of the system 104. Alternatively, or in addition, one or both of the sub-systems can include the valve and sensor system described with reference to FIG. 4. For example, in a flowline that is 30 feet long, two sub-systems can be implemented at a distance of 10 feet from each other. In some implementations, a third, fourth or additional sub-system can be implemented downstream or upstream of either of the first sub-system or the second sub-system. By implementing multiple such sub-systems along the length of the flowline 702, water separation can be enhanced.

Figure 8A:
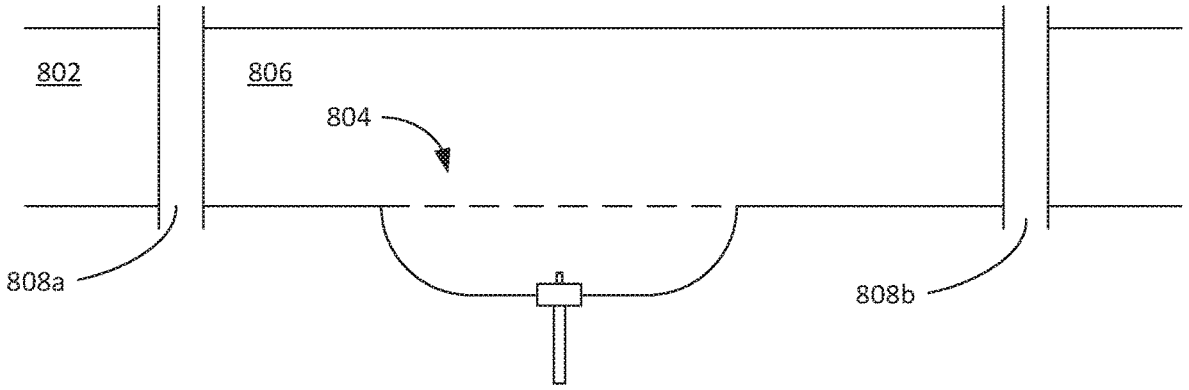
FIG. 8A is a schematic diagram of an example of a water separation system in a flowline.

FIG. 8A is a schematic diagram of an example of a water separation system 804 in a flowline 802. The system 804 can be attached to or formed in a flowline segment 806, which can then be connected to the flowline 802. The flowline segment 806 can include a portion of a pipeline having substantially similar features (for example, substantially equal diameter, thickness, material of manufacture and other features) as the flowline 806. The flowline segment 806 can be selected such that the flow of the mixture of hydrocarbons and water through the flowline segment 806 is substantially similar to that through the flowline 802. As described later with reference to FIG. 8B, the flowline segment 806 can be fluidically connected to the flowline 802 using two flange systems.

The system 804 includes a sink that can be attached to a bottom surface of the flowline 802. An outlet is formed at a bottom portion of the sink. A valve system is connected to the opening. In some implementations, the system 804 includes a perforated plate attached to the bottom surface of the flowline 802 between the flowline 802 and the sink. The valve system includes a valve, a sensor system connected to the valve and a drain pipe. The structural and functional features of components of the system 804 can be substantially similar or identical to the structural and functional features of corresponding components of the system 104 or any of the water separation systems described in this disclosure.

Figure 8B:
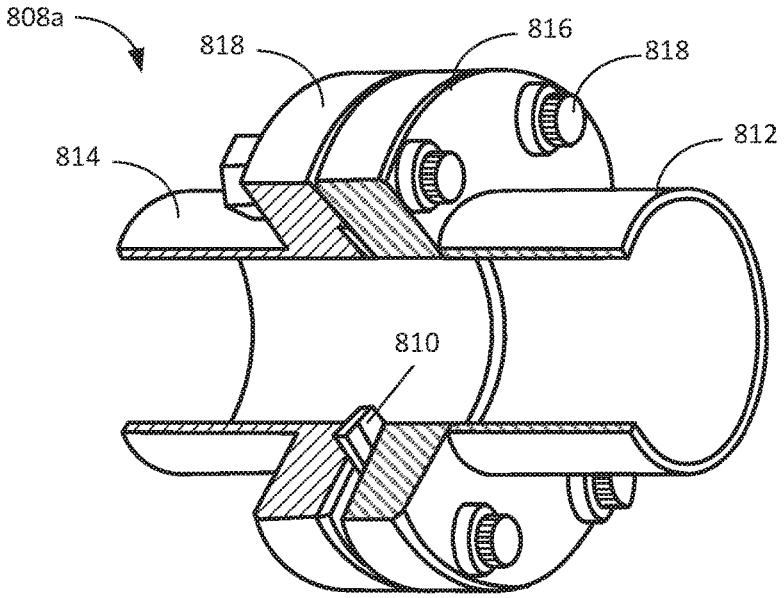
FIG. 8B is a schematic diagram of a flange system included in the water separation system of FIG. 8A.

FIG. 8B is a schematic diagram of a flange system included in the water separation system of FIG. 8A. For example, the flange system 808*a* can include a first portion 816 having a cross-section and diameter that is substantially similar to that of the flowline segment 806. The first portion 816 can be attached to a first extension portion 812 having an outer diameter that is less than an inner diameter of the flowline segment 806. A difference between the outer diameter of the first extension portion 812 and the inner diameter of the flowline segment 806 can be large enough to allow inserting the first extension portion 812 into the flowline segment 806 and small enough to prevent fluid from flowing between the outer surface of the first extension portion 812 and the inner surface of the flowline segment 806. The flange system 808*a* can include a second portion 818 having a cross-section and diameter that is substantially similar to that of the flowline 802. The second portion 818 can be attached to a second extension portion 814 having an outer diameter that is less than an inner diameter of the flowline 802. A difference between the outer diameter of the second extension portion 814 and the inner diameter of the flowline 802 can be large enough to allow inserting the second extension portion 814 into the flowline 802 and small enough to prevent fluid from flowing between the outer surface of the second extension portion 814 and the inner surface of the flowline 802. The first portion 816 and the second portion 818 can be axially connected to each other such that fluids flowed through the flowline 802 flow through the flange system 808*a* and into the flowline segment 806. A flange seal 810 can be positioned between the first portion 818 and the second portion 816 to seal the two portions and to prevent fluid leakage. The first portion 816 and the second portion 818, with the intermediate flange seal 810, can be securely attached to each other using fasteners (for example, fastener 818), for example, with threads, bayonets, or any other form of mechanical fastener.

The features of the flange system 808*b* can be substantially similar to those of flange system 808*a*. Implementing the flange systems 808*a* and 808*b* allows removably attaching the water separation system 804 to the flowline 802. The flow through the flowline 802 and the flowline segment 806 can be temporarily shut-off, and the water separation system 804 removed, for example, to perform any repairs, maintenance, cleaning or combination of them, to one or more of the water separation system 804, the flowline 802 or the flowline segment 806.

Thus, particular implementations of the subject matter have been described. Other implementations are within the scope of the following claims. For example, a water separation system can include one or more of any of the features shown in any of the schematic diagrams described earlier.

The invention claimed is:

1. A system comprising:

a pipeline having a diameter;

a flowline segment positioned in the pipeline, the flowline segment having the diameter of the pipeline;

a sink attached to the flowline segment, the sink configured to flow a mixture of at least two immiscible fluids, wherein one of the immiscible fluids is water, wherein the water is more dense than the other of the at least two immiscible fluids, wherein the sink is configured to collect at least a portion of the at least two immiscible fluids flow;

an outlet formed at a bottom portion of the sink; and a valve system connected to the outlet, the valve system configured to open the outlet in response to the water occupying at least a portion of the sink.

2. A system comprising:

a sink attached to a horizontal flowline configured to flow a mixture of at least two immiscible fluids, wherein one of the immiscible fluids is water, wherein the water is more dense than the other of the at least two immiscible fluids, wherein the sink is configured to collect at least a portion of the at least two immiscible fluids flow;

an outlet formed at a bottom portion of the sink;

a valve system connected to the outlet, the valve system configured to open the outlet in response to the water occupying at least a portion of the sink; and wherein the sink is attached in place of a removed bottom portion of the horizontal flowline, wherein the system further comprises a perforated plate configured to attach to a bottom surface of the horizontal flowline between the horizontal flowline and the sink, the perforated plate configured to flow at least the portion of the mixture of the at least two immiscible fluids from the horizontal flowline into the sink, the perforated plate positioned at the removed bottom portion between the horizontal flowline and the sink.

3. The system of claim 1, wherein the valve system comprises:

a valve; and a pressure sensor attached to the valve, the pressure sensor configured to sense hydrostatic fluid pressure.

4. The system of claim 3, wherein the pressure sensor is configured to:

store a pressure value; and transmit a valve-open signal to the valve in response to the sensed hydrostatic fluid pressure satisfying the stored pressure value.

5. The system of claim 4, wherein the pressure sensor is configured to transmit a valve-close signal to the valve in response to the sensed hydrostatic fluid not satisfying the stored pressure value.

6. The system of claim 3, wherein the valve is connected to one or more data networks and is configured to:

receive a valve-open signal over the one or more data networks;

open the outlet in response to receiving the valve-open signal;

receive a valve-close signal over the one or more data networks; and close the outlet in response to receiving the valve-close signal.

7. The system of claim 1, wherein the valve system comprises:

a valve;

a perforated cylinder positioned in the sink; and a sensor system positioned within the perforated cylinder, the sensor system configured to open the valve based on the water occupying at least a portion of the perforated cylinder.

8. The system of claim 7, wherein the sensor system comprises:

an upper sensor attached to an upper surface of the perforated cylinder;

a lower sensor attached to a lower surface of the perforated cylinder; and a floating member positioned in the perforated cylinder between the upper sensor and the lower sensor, the floating member configured to float in water.

9. The system of claim 8, wherein the upper sensor is configured to transmit a valve-open signal in response to being contacted by the floating member, and wherein the lower sensor is configured to transmit a valve-close signal in response to being contacted by the floating member.

10. The system of claim 9, wherein the valve is configured to open the outlet in response to receiving the valve-open signal from the upper sensor, and wherein the valve is configured to close the outlet in response to receiving the valve-close signal from the lower sensor.

11. The system of claim 10, further comprising a weir positioned in the sink, the weir configured to accumulate the water in a portion of the sink.

12. The system of claim 11, wherein a height of the weir is less than a distance between the bottom surface of the flowline segment and the bottom portion of the sink.

13. The system of claim 1, wherein the sink comprises:

a first portion comprising an upper end and a lower end, the upper end of the first portion attached to an upstream end of the bottom portion of the flowline segment;

a second portion comprising an upper end and a lower end, the upper end of the second portion attached to a downstream end of the bottom portion of the flowline segment, the downstream end being downstream of the upstream end; and an intermediate portion comprising an upstream end and a downstream end, the upstream end of the intermediate portion attached to the lower end of the first portion, the downstream end of the intermediate portion attached to the lower end of the second portion.

14. The system of claim 13, wherein each of the first portion and the second portion is substantially curved.

15. The system of claim 13, wherein each of the first portion and the second portion is substantially flat.

16. The system of claim 13, wherein each of the first portion and the second portion angles downward from the bottom surface of the flowline segment toward the sink.

17. The system of claim 1, further comprising an up-slope portion attached to the flowline segment, the up-slope portion positioned downstream of the sink, wherein the up-slope portion tapers in an upstream direction.

18. The system of claim 1, wherein the sink is a first sink, the outlet is a first outlet and the valve system is a first valve system, wherein the system comprises:

a second sink configured to attach to a bottom surface of the flowline downstream of the first sink;

a second outlet formed at a bottom portion of the second sink; and a second valve system connected to the second outlet, the second valve system configured to open the second outlet in response to the water occupying at least a portion of the second sink.

19. The system of claim 1, further comprising a second flowline segment having a second bottom surface to which a second sink is configured to attach, the second flowline segment being separate from the flowline segment through which the mixture of the at least two immiscible fluids is configured to flow.

20. The system of claim 19, wherein an outer diameter and cross-section of the second flowline segment is substantially identical to an outer diameter and cross-section, respectively, of the flowline segment.

21. The system of claim 20, further comprising a flange system configured to fluidically connect the flowline segment and the second flowline segment.

22. The system of claim 1, further comprising a heating coil positioned within the sink, the heating coil configured to heat a fluid within the sink to prevent hydrate formation.

23. The system of claim 22, wherein the heating coil comprises an electric heating coil.

24. The system of claim 23, further comprising:

a temperature sensor configured to detect a temperature within the sink; and a temperature controller configured to regulate an energy flow into the heating coil.

25. The system of claim 24, wherein the temperature controller comprises a current regulator.

26. The system of claim 1, wherein the sink is attached in place of a removed bottom portion of the flowline segment, the system further comprises a perforated plate configured to attach to a bottom surface of the flowline segment between the horizontal flowline and the sink, the perforated plate configured to flow at least the portion of the mixture of the at least two immiscible fluids from the flowline segment into the sink, the perforated plate positioned at the removed bottom portion between the flowline segment and the sink.

* * * * *